US005152734A

United States Patent [19]

McAdam, III et al.

[11] Patent Number: 5,152,734

[45] Date of Patent: Oct. 6, 1992

[54] APPARATUS FOR FOLDING A TRAILING PANEL ON CARTON BLANKS

[75] Inventors: Hugh A. McAdam, III, Wilton, N.H.; Jeffrey C. Lindberg, Princeton; Paul Burnside, West Townsend, both of Mass.

[73] Assignee: International Paper Box Machine Co., Inc., Nashua, N.H.

[21] Appl. No.: 597,439

[22] Filed: Oct. 15, 1990

[51] Int. Cl.[5] ..... B31B 3/52; B31B 3/54

[52] U.S. Cl. ..... 493/10; 493/23; 493/177

[58] Field of Search ..... 493/10, 23, 30, 177, 493/182

[56] References Cited

U.S. PATENT DOCUMENTS

| | | | |
|---|---|---|---|
| 3,405,611 | 10/1968 | Millich | 493/177 |
| 4,432,745 | 2/1984 | Eldridge | 493/10 |
| 4,539,002 | 9/1985 | Zak | 493/23 |
| 4,629,445 | 12/1986 | Toriyama | 493/10 |
| 4,715,846 | 12/1987 | Zak | 493/10 |
| 4,747,813 | 5/1988 | Genoud et al. | 493/177 |
| 5,021,041 | 6/1991 | Pigeau et al. | 493/177 |

*Primary Examiner*—William E. Terrell
*Attorney, Agent, or Firm*—Pearson & Pearson

[57] ABSTRACT

Apparatus for a paper box folding machine for folding the trailing panels of carton blanks about fold lines as the blanks travel individually and successively along a paper line. A servomotor running continuously at a relatively constant nominal angular velocity drives the input shaft to an indexer that controls, for each position of its input shaft, the angular position of its output shaft. The indexer converts continuous input from the servomotor to discontinuous motion of its output shaft. The output shaft lies below and transverse to a paper line. Radially extending fingers mounted on the output shaft are positioned below a trailing panel as the carton blank passes. The indexing means output shaft and fingers rotate rapidly so the fingers engage and fold the trailing panel and then dwell to allow the blank to exit the apparatus. Then the shaft and fingers move below the paper line to allow another blank to enter and rotate to engage a next blank in sequence. A specific embodiment includes two folding stations and the control system for operating these stations independently.

22 Claims, 11 Drawing Sheets

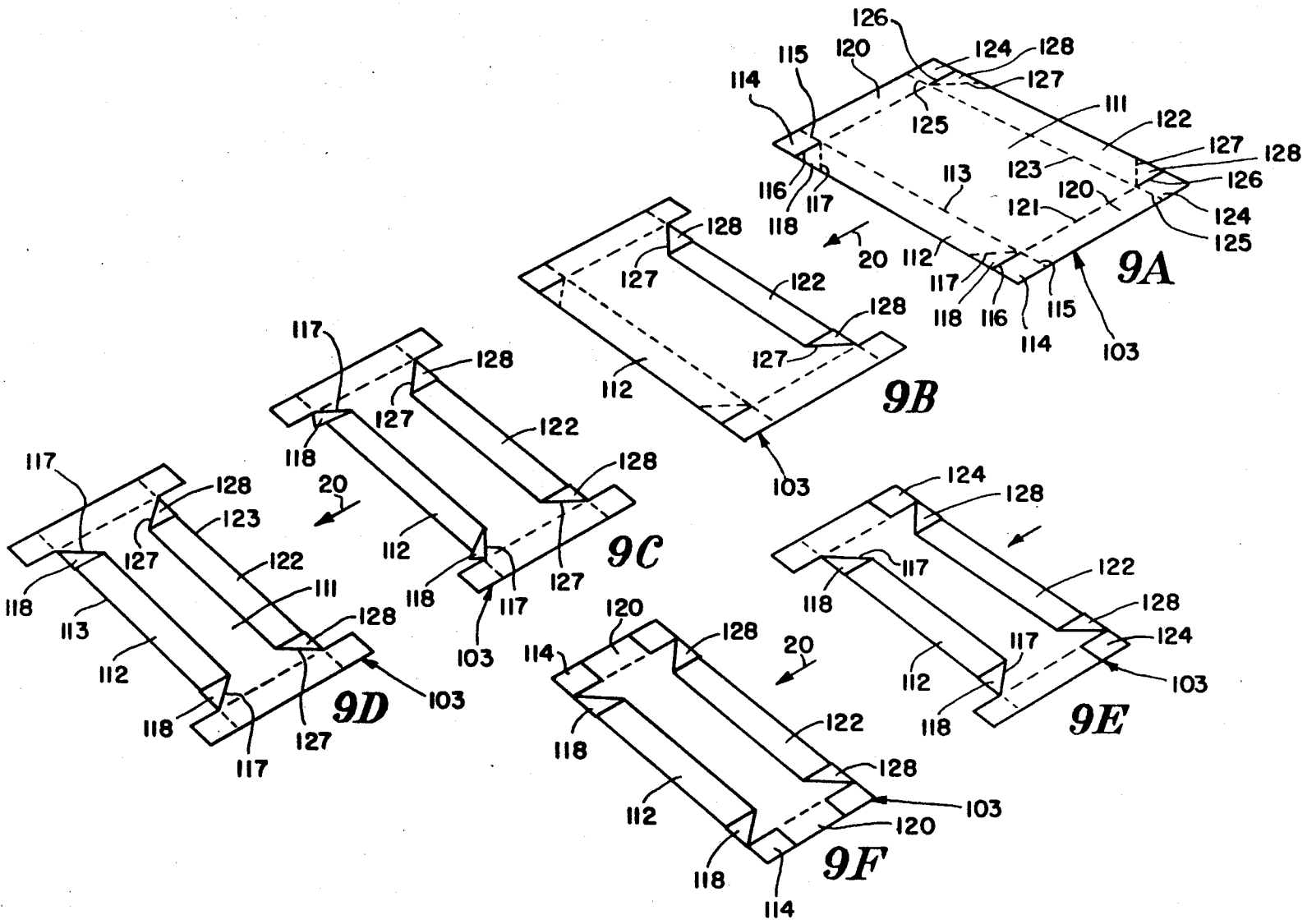
9A
9B
9C
9D
9E
9F
103
111
112
113
114
115
116
117
118
120
121
122
123
124
125
126
127
128
20

APPARATUS FOR FOLDING A TRAILING PANEL ON CARTON BLANKS

BACKGROUND OF THE INVENTION

1. Field of the Invention

This invention relates to apparatus for manufacturing folding carton blanks and, more folding the trailing panels of such specifically, to apparatus for 2. Background In machines for folding blanks successively and individually, the blanks travel through a series of stations. Apparatus at each station performs, sequentially, some folding, gluing or other operation on individual panels formed on the blanks as successive blanks pass that station. A conveyor system transports the blanks past each station in seriatim, normally on a "paper line".

Folding operations require a trailing panel to be folded forward (i e , in the direction of travel of the conveyor) about a fold line that is transverse to the paper line. Trailing panel folding operations present special problems in carton folding because the blank must pass the folding station before the apparatus can engage and fold the panel Some systems fold trailing panels by using a so-called "right angle" paper line. Essentially, the apparatus folds and glues all panels on the front and sides along a first paper line Then the apparatus directs the blanks to a second paper line that runs at right angles to the first paper line. If the orientation of the blank in space remains the same during the transfer, the trailing panel on the first line becomes a side panel on the second line and can be folded as a convent side panel. This apparatus has several drawbacks. First, the transfer from one line to another requires care often achieved by increasing the spacing between blanks and slowing conveyor speed. This reduces machine throughput. Moreover, right-angle systems generally require more floor area than straight-line systems; consequently overheads increase, so this apparatus is more costly to operate.

There has been an effort to develop trailing panel folding stations that operate in a straight-line, or in-line, apparatus. The following United States Letters Patent disclose prior efforts:

U.S. Pat. No. 3,330,185 (1967) Annett et al
U.S. Pat. No. 3,901,134 (1975) Reizenstein et al
U.S. Pat. No. 4,119,018 (1978) Nava
U.S. Pat. No. 4,432,745 (1984) Eldridge
U.S. Pat. No. 4,539,002 (1985) Zak
U.S. Pat. No. 4,715,846 (1987) Zak Annett et al disclose a box folding machine apparatus. A cam mechanism driven from a shaft rapidly accelerates an arm on a head to overtake a rear panel and fold it on top of a blank.

In accordance with Reizenstein et al, a clutch has an input connected to the main drive of the folding box apparatus and an output connected to a secondary drive for an endless operating loop. A sensing means responds as each blank passes a reference point by causing the clutch to engage and initiate motion of the endless operating loop that is synchronized to the position of the blank. Folding fingers pivotally connect to the loop and have cam followers that engage a stationary cam. Each finger moves into contact with a box blank at the trailing panel as the cam follower contacts the cam. A second sensing means and related apparatus disengage the clutch when the folding finger reaches a predetermined position after completing the folding operation.

Nava discloses a system with a trailing edge sensor that initiates the operation of a folding head with a cam control element. This control element moves folding fingers with an appropriate velocity profile to engage and fold a trailing panel The mechanism includes a shaft for the folding heads, an idler shaft that carries the cam, a braking mechanism and a clutch.

Eldridge discloses a trailing panel folding machine with a two-armed head that rotates one-half revolution each time it folds a trailing panel. A drive motor and clutch-brake assembly drive the head. The clutch-brake comprises an electromechanical or a pressure- or vacuum-operated mechanical device. A variable speed electric motor rotates the head at a speed dependent upon the length of the blanks. Alternatively it is suggested to tie the drive to the conveyor drive motor thereby to compensate any changes in conveyor speed.

When Eldridge's clutch-brake engages, the head rotates at the speed of the drive for 180° (i.e., the angle needed to perform one folding operation). When the clutch-brake disengages, the head stops rotating. A sensor determines the position of a blank as it travels along a conveyor. The resulting position information and conveyor speed information establish timing for engaging the clutch-brake mechanism and initiating a two-step folding cycle. The drive head begins at a starting or dwell position with the clutch-brake disengaged. During a first step, a signal from an electronic controller causes the clutch-brake to engage and rotate the head to fold the trailing panel and then to disengage and stop the head in an intermediate position. This allows the blank to pass from the folding station. After another interval, that assures that the blank has cleared this station, the controller initiates the second step during which the clutch-brake engages to move the folding head to a separate home position below the paper line where the head dwells in preparation for the next blank.

The Zak-002 patent discloses a trailing panel folding apparatus in which folding heads connect to a drive through a clutch-brake that responds to various control signals. When the trailing edge of a blank passes a predetermined position, the signals cause the clutch to engage and rotate folding fingers on the heads and fold the trailing panel. Then the stop and subsequently rotate again to a dwell position to complete a two-step folding operation.

The Zak-846 patent discloses a trailing panel folding apparatus in which a servomotor directly drives a shaft carrying two folding heads. Each head has a pair of radially extending arms that engage and fold the trailing panels of successive blanks. A computer and programmable motor controller directly control the rotation and velocity profiles of the servomotor in a two-step cycle comprising a fold step and a return step. During the fold step, one arm starts below the conveyor and rotates at an appropriate time to engage the trailing panel and fold it over. In a vertical position, the drive shaft dwells to allow the blank to exit from under the folding arm. Then the return step positions the second arm just below the conveyor so it is oriented at the starting position.

These embodiments of apparatus for folding a trailing edge or panel have some common characteristics. First, they all, except for the apparatus with Zak-846 patent, contain mechanisms that must physically engage and disengage. These operations require finite time intervals that, in part, are determined by the momentum changes inherent whenever an element starts and stops. This apparatus, particularly including the apparatus of the Zak-846 patent, involves significant rapid and repeated changes in momentum, particularly as the mass of the elements involved is significant and the process is iterative in nature. These requirements can impose limits on parameters such as minimum blank spacing and maximum conveyor speed that individually and collectively limit throughput.

For example, the conveyor speed for in-line apparatus is generally a function of the capabilities of the trailing panel folding apparatus to accelerate, engage and overtake the blank and then to stop so the folded blank can exit. This, in turn, depends upon the physical inertia of the folding system and the characteristics of various elements, such as motors, used to drive the folding element. Minimum spacing between successive blanks depends, in part, upon the time interval required to move the folding element from a dwell position above a paper line to a position below the paper line that allows the next blank to enter the backfolding station. This interval also depends on the physical inertia of the folding element and its associated drive mechanism and the ability of the drive system accelerate and decelerate.

SUMMARY OF THE INVENTION

Therefore it is an object of this invention to provide apparatus for backfolding trailing panels of blanks and for increasing throughput by minimizing the mass of elements that must accelerate and decelerate during each folding operation.

Another object of this invention is to provide apparatus for backfolding trailing panels in successive blanks transported along a paper line that increases throughput and compensates for variations in conveyor speed.

Still another object of this invention is to provide apparatus for backfolding trailing panels in successive blanks transported along a paper line that increases throughput and compensates for variations in spacing between successive blanks.

Yet another object of this invention is to provide apparatus for backfolding trailing panels in successive blanks transported along a paper line that is adapted for backfolding panels from batches of differently sized blanks.

Yet still another object of this invention is to provide apparatus for backfolding trailing panels in successive blanks transported along a paper line that adapts to a variety of operating conditions.

In accordance with one aspect of this invention, apparatus in a backfolding station for folding the trailing panels of successive blanks comprises a servomotor, an indexing system for rotating an output shaft with folding finger means that engage the trailing panels, and a control system. The indexing system converts input motion from the servomotor into a predetermined discontinuous motion of the finger means that depends upon the position of successive blanks The synchronized folding finger means fold the trailing panels and then dwell until the blank exits the backfolding station. Then a new cycle begins as the servomotor and indexing system moves the folding finger means to engage the trailing flap of a next blank in succession.

In accordance with other aspects of this invention, a control system establishes a nominal angular velocity for the servomotor. The control system varies the average and instantaneous servomotor velocities as a function of blank and trailing panel size, the blank velocity along the paper line, as represented by conveyor speed, and the spacing between successive blanks. The servomotor and input portion of the indexing mechanism operate with essentially constant momentum. Only a small portion of the mass of the indexing mechanism and its attached output shaft are subject to rapid momentum changes, and these momentum changes are readily absorbed within the system.

BRIEF DESCRIPTION OF THE DRAWINGS

This invention is described with particularity in the appended claims. The various objects, advantages and novel features of this invention will be more fully apparent from a reading of the following detailed description in conjunction with the accompanying drawings in which like reference numerals refer to like parts, and in which:

FIG. 9 includes a series of perspective views in FIGS. 9A through FIG. 9F that illustrate the effects of various operations on a blank;

DESCRIPTION OF ILLUSTRATIVE EMBODIMENTS

Figure 1:
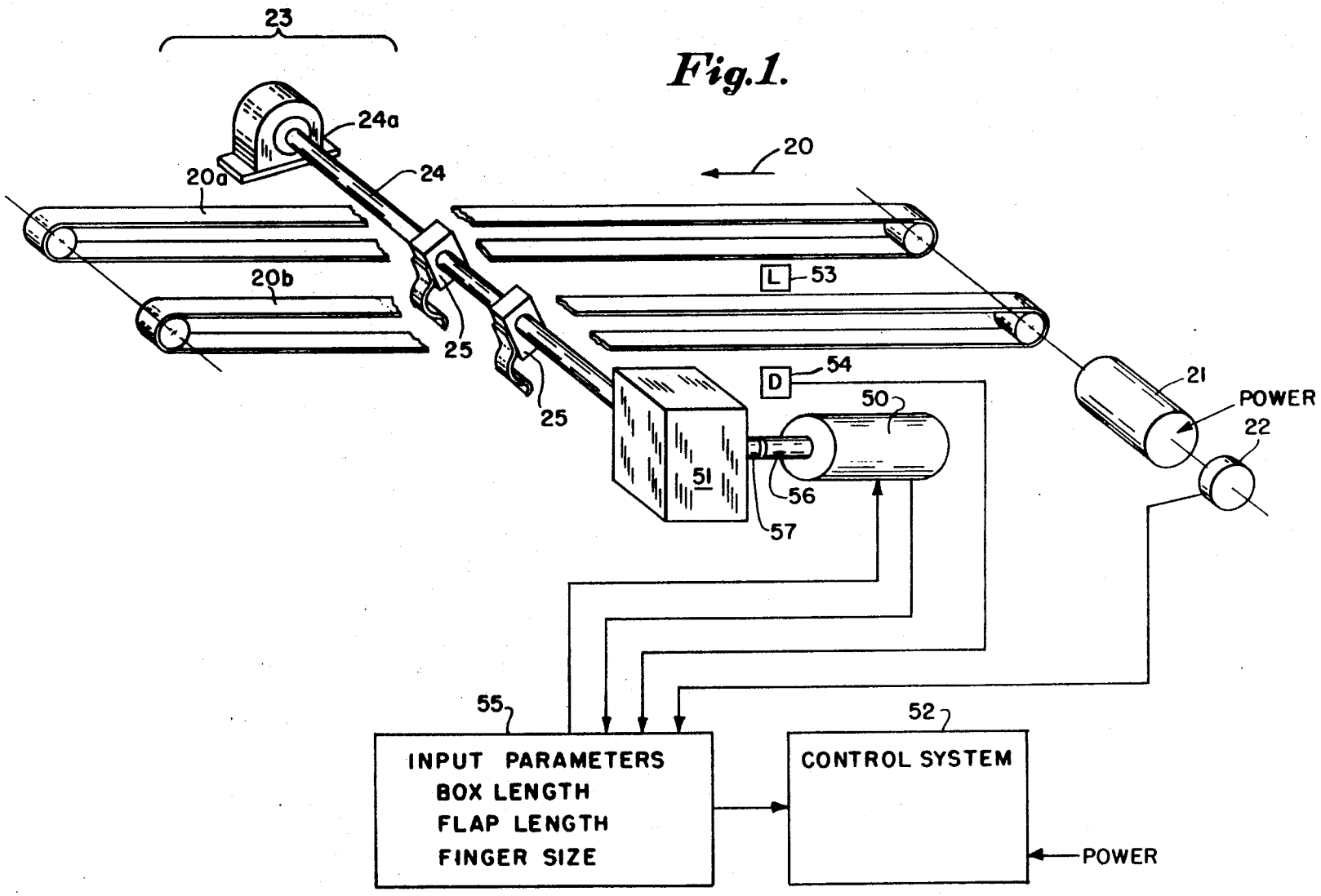
FIG. 1 is a simplified diagram, partially in perspective form and partially in schematic form, of a backfolding station constructed in accordance with this invention.

FIG. 1 is a diagrammatic view of a single backfolding station to illustrate the relationship between various elements of such a station and a paper line 20 including continuous conveyor belts 20*a* and 20*b*. In actual practice, a typical paper line 20 comprises one or more sets of vertically aligned belts spaced along the length of the paper line 20. The disclosed backfolding station also includes a drive motor 21 and a tachometer 22 or other device that generates a signal indicating conveyor speed. Typically the drive motor 21 connects to the paper line 20 through a series of shafts and drive transmissions that are not shown here for purposes of clarity.

A backfolding station 23 comprises an output shaft 24 that is transverse to and below the paper line 20, so blanks pass above the shaft 24 as they travel along the paper line 20. The shaft 24 carries two or more folding finger assemblies 25, each folding finger assembly comprising a block and single finger. A journal bearing assembly 24*a* supports the far end of the output shaft 24 as shown in FIG. 1.

Figure 2:
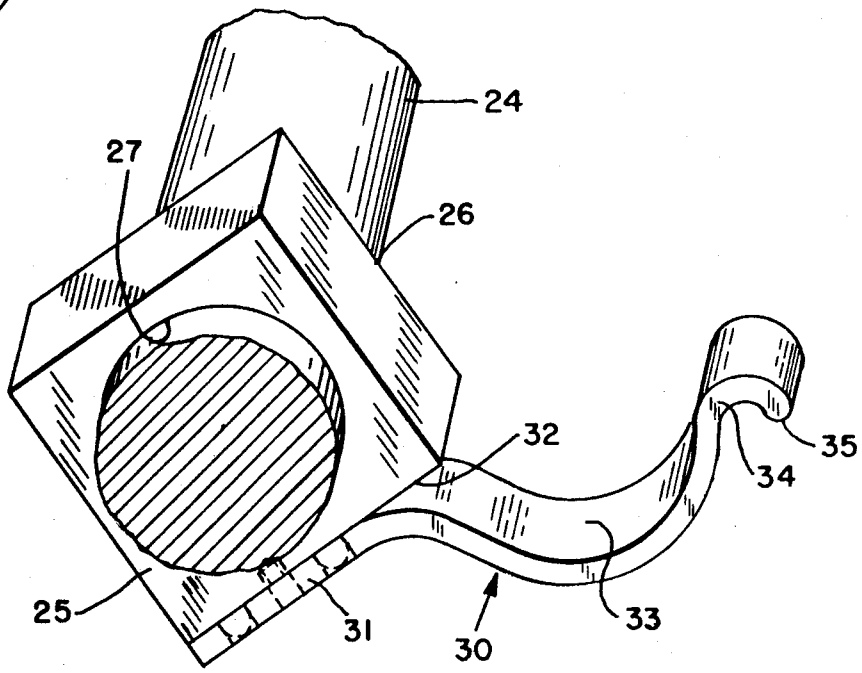
FIG. 2 is a perspective view of a folding finger means for use in apparatus that embodies the invention of FIG. 1.

There are many possible configurations for the folding finger assemblies using either fixed length or variable length fingers The following description of three specific embodiments provides an understanding of the important features of these fingers and the interaction between the fingers and the remaining apparatus. For example, FIG. 2 discloses one embodiment of a folding finger assembly 25 that is particularly adapted for use with blanks having relatively short trailing panels as measured transversely to the fold line (i.e., less than 3.5 inches deep). It comprises a block 26 with a bore or sleeve 27 for mounting to the output shaft 24 by conventional means. A single finger 30 includes a flat portion 31 at one end Rivets, machine screws or other conventional means affix the flat portion 31 to an edge surface 32 of the block 26. The balance of the finger assembly 30 has an "S" shape. A first portion 33 or base of the "S" produces an offset away from the Referring again to FIG. 1, a control system 52 controls the servomotor 50 in response to a number of inputs. These inputs include the paper line speed signal generated by the tachometer 22, velocity and position signals from the servomotor 50 and blank position signals generated by a photodetector system. FIG. 1 also discloses a photodetector system in which a lamp 53 directs light across the paper line 20 to actuate a detector 54 between individual blanks. Other photodetector systems, such as reflector systems, or other position sensing systems can be substituted for the specifically disclosed system in FIG. 1. In addition, FIG. 1 discloses only a single photodetector system. It is also possible to use multiple photodetector systems with the generation of independent blank position signals, as will become apparent later. An input keyboard 55 enables an operator to define input parameters such as box length, flap length and finger size.

In FIG. 1 the servomotor 50 has a horizontal output shaft 56 that directly couples to an input shaft 57 for the indexer 51. FIG. 1 also depicts a direct coupling for clarity; in an actual embodiment, a timing chain couples the input shaft 57 and the output shaft 56. Further, this coupling can provide a speed reduction In one particular embodiment, the coupling provides a 2:1 speed reduction; that is, the servomotor output flat surface 32 while an inverted "U" shaped portion 34 completes the "S" at a rounded tip 35.

Figure 3:
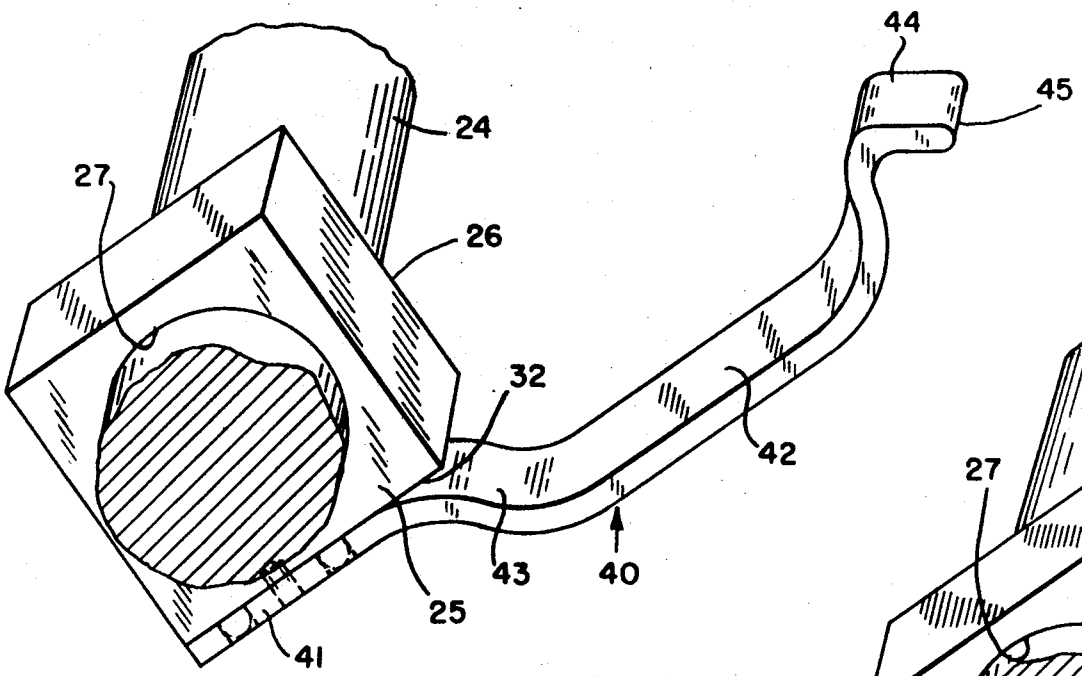
FIGS. 3 and 3A are perspective views of alternative embodiments of folding finger means shown in FIG. 2.
Figure 3A:
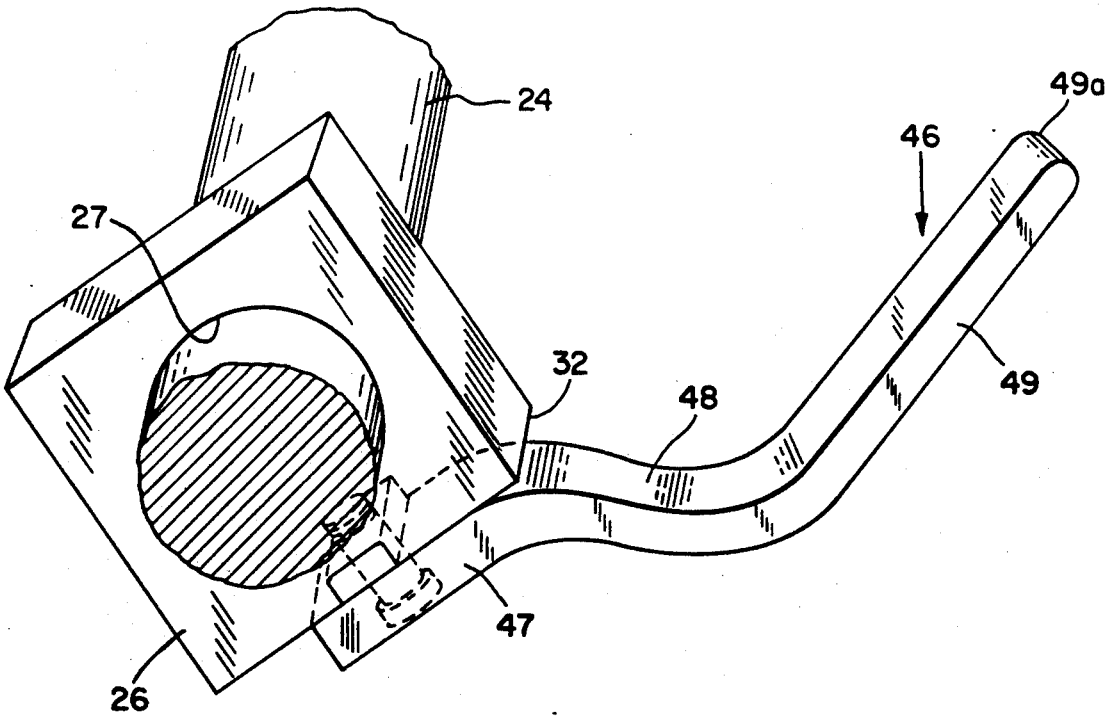

FIGS. 3 and 3A depict alternative folding finger assembly for use with blanks having large trailing panels (i.e., in excess of 3.5 inches deep). The folding finger assemblies in FIGS. 3 and 3B contain similar blocks 26 with bores or sleeves 27 and supporting surfaces 32. In the embodiment of FIG. 3 a single finger 40 has a flat end portion 41; rivets, machine screws or similar devices secure the end portion in 41 to the edge surface 32 of the block 26. One end of an elongated section 42 connects to an offset 43 that produces an elongated bottom portion of an "S" shape. A top portion 44 of the "S" and rounded tip 45 connect to the other end of the central section 42. The top portion 44 and tip 45 are similar to the end section 34 and rounded tip 35 in FIG. 2.

In FIG. 3A, a finger 46 has an end portion 47 that connects to the edge surface 32. A central offset portion 48 interconnects the end portion 47 and a straight section 49 that terminates in a rounded tip 49*a*. Bends at the offset 48 normally orient the straight section 49 so it is oblique to the plane of the end section 47 and is directed back to an extension of that plane. The longer distance between the central axes of the apertures 27 and the output shaft 24 and the rounded tips 45 accommodates blanks with larger or deep, trailing panels. shaft 56 rotates two revolutions for each revolution of the indexer input shaft 57 and the output shaft 24.

Before discussing a specific embodiment in detail, it will be helpful to review the problems of prior art apparatus, discuss the principles of operation for the apparatus in FIG. 1 in terms of an elementary model and then the adaptation of the elementary model to practical apparatus. The previously described prior art apparatus accelerates and decelerates folding fingers between zero, or dwell, momentum and some maximum momentum. Some prior art apparatus uses clutch-brake mechanisms to couple and decouple a folding finger assembly from a drive motor. The drive motor may comprise an independent motor or a power take-off from the main drive for the paper line.

Other prior art identifies problems with such clutch-brake mechanisms including an inability to vary the velocity of the folding fingers during each folding operation. The prior art substitutes a servomotor drive for both the drive motor and the clutch-brake mechanism to overcome this problem and to permit such velocity variations. However, it is necessary to accelerate and decelerate the entire rotating mass of the folding apparatus between the zero and maximum velocities during each folding operation, including the servomotor rotor with its significant mass. From a practical standpoint, it is difficult to obtain servomotors that operate under the desireable high throughput conditions for paper box folding apparatus and provide the required acceleration and deceleration and attendant major momentum changes encountered in trailing panel folding operations. The apparatus shown in FIG. 1 and constructed in accordance with this invention overcomes both the constant velocity problem of clutch-brake mechanisms and the significant momentum change problem of direct servomotor drive apparatus by interposing the indexer 51 intermediate the servomotor 50 and the folding finger output shaft 24.

The indexer 51 establishes a specific relationship between each angular position of its input shaft 57 and the output shaft 24. In one specific embodiment the input mechanism for the indexer comprises a cam attached to the shaft 57. The cam has a concave globoidal shape and a circumferential tapered rib. A hub with a number of radially mounted cam followers drives the output shaft 24. Specifically, as the tapered rib rotates, the followers translate any displacement of the rib axially along the shaft 57 into rotary motion of the shaft 24. The use of plural ribs on the cam surface enable the followers to rotate the shaft completely. Such devices are known in the art; one such device is manufactured by Ferguson Machine Company of St. Louis, Mo.

The indexer 50 effectively decouples the significant mass of the servomotor 50 from the minimal mass of the output shaft 24 and the folding fingers 25, so momentum changes during each folding operation are small in comparison with the average momentum of the entire assembly. Specifically, the indexer cam and its input shaft 57 connect directly, or indirectly through a timing chain or other speed reduction device, to the servomotor output shaft 56 with its connected rotor. Lands on the cam in the indexer produce the necessary velocity changes through the cam followers, but for purposes of understanding the elementary model, the cam, its input shaft 57 and the servomotor rotor and its output shaft 56 rotate with an essentially constant velocity and hence an essentially constant momentum. The mass of the cam follower in the indexer 51 the output shaft 24 and folding fingers is a small percentage of the total mass that rotates during a folding operation. Thus, the momentum changes associated with the accelerations and decelerations during each folding operation are small in comparison with the total momentum of the folding apparatus. If a cam were specially constructed for a specific blank configuration, the momentum changes that would occur during each folding cycle could be made to balance or substantially balance. If such a balance were achieved, the servomotor 50 would operate at a substantially constant velocity even during each rotation of the output shaft 24 and folding finger assemblies 25.

Figure 4:
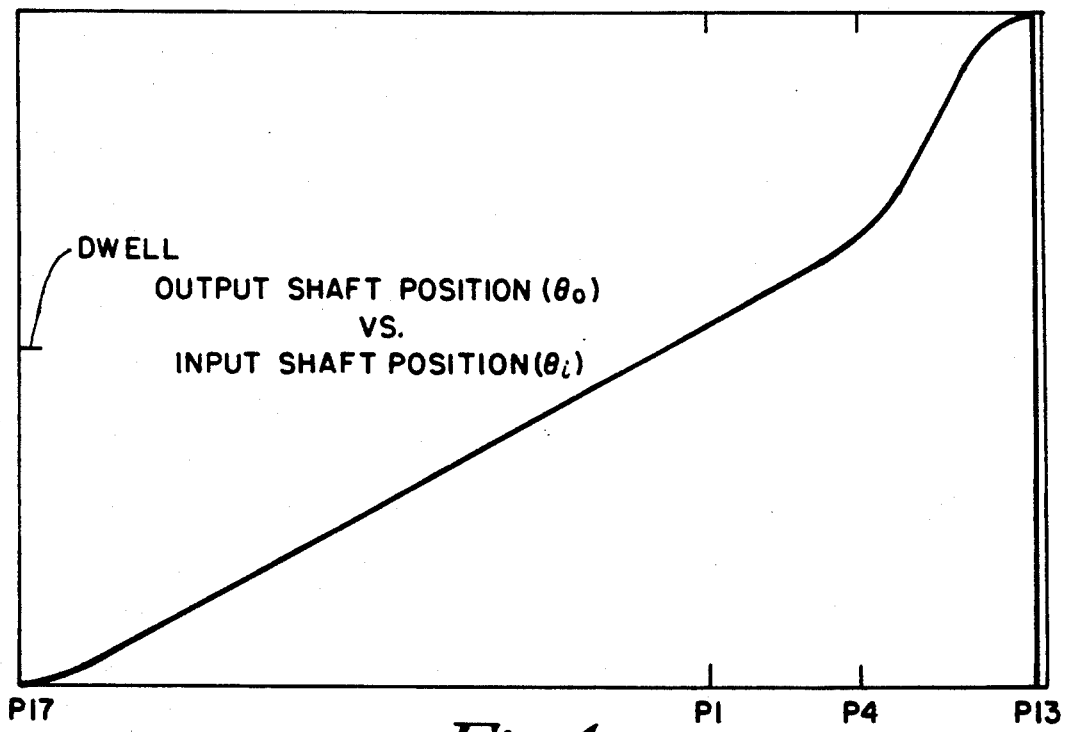
FIG. 4 graphically relates the relationship between output and input shaft angular position for the indexing mechanism shown in FIG. 1.
Figure 5:
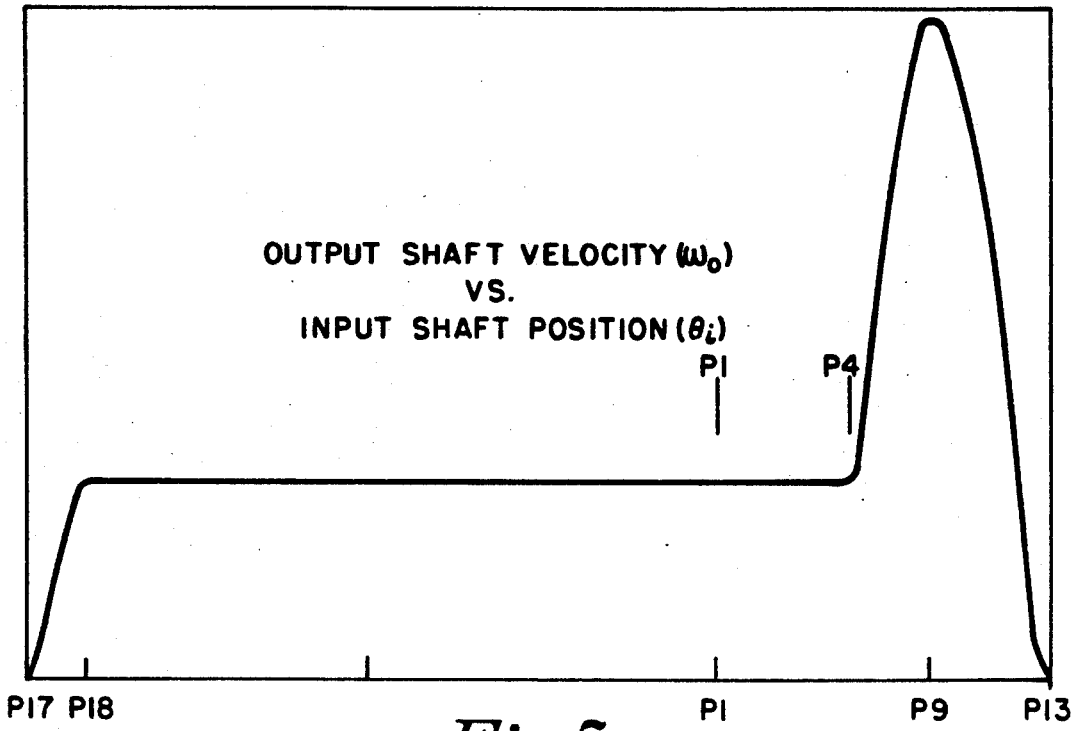
FIG. 5 graphically relates output shaft velocity to input shaft position for the indexing mechanism shown in FIG. 1.
Figure 6:
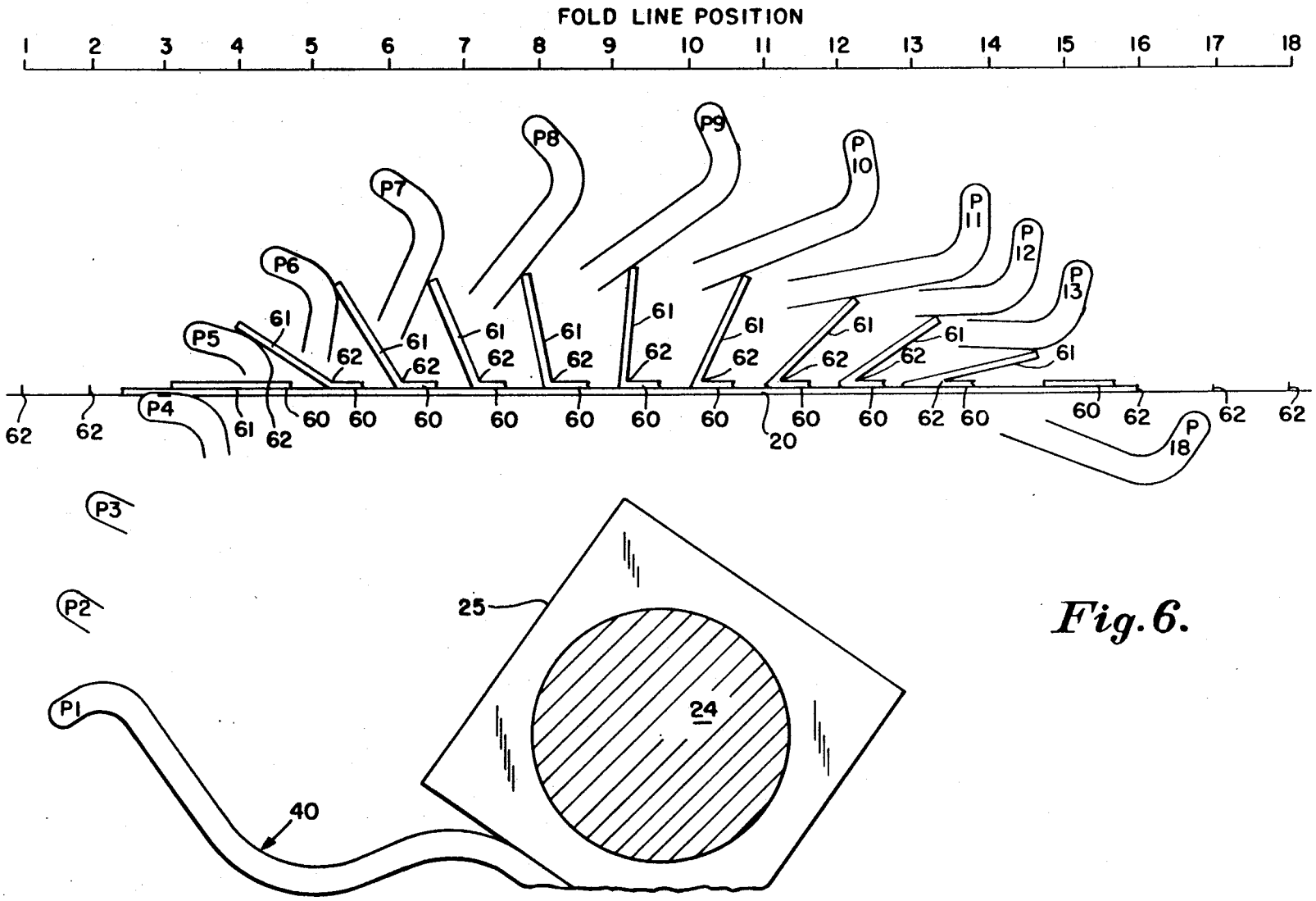
FIG. 6 depicts the relationship between various angular positions of the folding finger means in FIG. 2 and blank positions as a blank passes the folding finger means and the folding finger means backfolds a trailing panel.

FIGS. 4 through 6 depict operating conditions for a typical indexing mechanism and folding apparatus that is useful in understanding this invention. In these Figures, the reference numerals P1 through P18 refer to specific positions of a blank 60 as it moves along the paper line 20 with respect to the output shaft 24. The positions are equidistant apart, so the intervals are also equal in time, assuming the paper line 20 runs at constant speed. Each of the numerals P1 through P18 refers also to a specific angular positions of the input and output shafts and finger 40 as shown in FIG. 6. A P1 position represents a position with a fixed angular displacement before the fingers 25 engage a trailing panel. A P13 position represents the position at which the finger 40 dwells while a blank 60 exits the backfolding station. This is a "HOME" position. The intersection of the ordinate and abscissa in FIGS. 4 and 5 represents a position of the finger 40 intermediate the dwell position P13 and the next position P18 shown in FIG. 6.

An operating cycle begins with the finger 40 in the dwell, or "HOME", position. During the interval from P13 to P17 the profile of the cam and rib in the indexing mechanism remains axially stationary, so the output shaft 24 is stationary even though the input shaft 57 continues to rotate.

When the input shaft 57 reaches an angular position corresponding to position P17, the rib on the cam shifts axially and accelerates the output shaft 24 to a nominally constant velocity until the output shaft 24 reaches the position P4. The control system determines the velocity so the finger 40 arrives immediately below a trailing panel 61 of a next blank 60 travelling along the paper line 20.

During the interval form P4 through P0 the output shaft 24 accelerates to a maximum velocity, and the finger 40 rapidly moves the panel 61 to a nearly vertical position with to the blank 61 about a fold line 62. From positions P9 through P13, the output shaft decelerates to dwell at position P13. As the finger 40 decelerates, it continues to fold the panel 60 as the surface of the finger 40 moves to a position that parallels to the paper line. Then the finger 40 begins its dwell at the "HOME" position P13 until the blank clears the backfolding station.

From the foregoing discussion, it will be apparent that the finger mechanism 25 turns at an essentially constant velocity during the intervals from P17 through P4 under steady-state conditions. Thus, no change in momentum occurs in the entire backfolding station during that interval. The momentum does change from positions P5 through P18 because the finger 40 accelerates, decelerates, dwells and accelerates again. In accordance with this invention, however, the change in momentum is limited in absolute terms because only the cam followers and hub in the indexer 51 and the output shaft 24 and finger assemblies 25 undergo acceleration and deceleration.

As previously stated, the mass of these elements as a percentage of the total mass of the rotating portions of the servomotor 50, indexer 51, output shaft 24 and finger assemblies 25 is small, so the change in momentum, as a percentage of total momentum, is also small.

If the conveyor speed and carton spacing were to remain constant, the servomotor output shaft 56 would turn at a relatively constant velocity during each folding operation and over successive folding operations. These conditions rarely exist in actual apparatus; it just is not possible to guarantee absolutely constant conveyor speed or constant spacing. Therefore, the control system increases or decreases the velocity of the servomotor output shaft 56 during each folding operation to compensate such changes. For example, the control system increases or decreases servomotor velocity if, after the trailing edge of a blank passes the detector 54, the paper line speed increases or decreases, respectively. For a given conveyor speed, the control system also increases or decreases servomotor velocity to compensate for decreased or increased spacing between successive blanks.

More specifically, the control system monitors the conveyor speed signal from the tachometer 22, the blank detector signal from the photodetector 54, and the position of the servomotor 50 as shown in FIG. 1. The resulting servomotor velocity adjustments are incremental. During startup the control system 52 utilizes conveyor speed from the tachometer 22 and the arrival of the leading and trailing edges of a blank as detected by the photodetector 54 to determine the time needed for the blank to reach the P4 position and the time required for the blank to pass through the system. The control system 24 again adjusts the speed of the servomotor 50 to compensate variable conveyor speed and synchronize backfolding operations to conditions of the paper line 20.

It also is possible to "jog" the folding system incrementally and obtain appropriate operation in the backfolding stations. In this operating mode, the servomotor does start and stop during each operating cycle. However, the "jog" made is a diagnostic mode and the intervals required to accommodate large changes in angular momentum are not detrimental.

Thus, backfolding apparatus constructed in accordance with this invention has several advantageous characteristics. During normal operations, the rotary portion of the servomotor and the input cam of the indexer operate at a steady-state condition. The portions of the apparatus that do undergo significant acceleration and deceleration under steady state conditions (i.e., the cam follower, output shaft and fingers) during each folding cycle have minimal mass, so the total change in momentum is small in comparison with the total momentum of the backfolding apparatus. Even when the control system changes the servomotor speed to accommodate variations in operating conditions such as paper line velocity and blank spacing, the speed of the control system normally alters servomotor speed only as a small percentage of its nominal speed. Even during such variations, the servomotor runs continuously, but at slightly changed velocities, so no significant changes in momentum occur even as such operating conditions change. These characteristics improve throughput because the paper line 20 can operate at a higher speed with closer blank spacing than can be attained with prior art systems.

Apparatus operated in accordance with the foregoing description could operate with a given blank configuration, but would not operate with all of the advantages of this invention for different blank configurations. Trailing panel folding apparatus must accommodate a wide range of carton configurations In accordance with another aspect of this invention, it is possible to adapt the apparatus with diverse blanks by controlling servomotor velocity control continuously during each folding operation.

In one embodiment, each folding operation, as shown in FIG. 6, comprises three segments. Segment A corresponds to the positions from P13 where the folding fingers 25 dwell to position P18 where the folding fingers 25 pass just below the paper line 20. Segment B corresponds to positions P18 to a position near position P4 representing the interval during which the folding fingers rotate from a point just below the paper line 20 to a point just before they pass the paper line 20 in an upward direction (as applied to FIG. 6) and strike the trailing panel 61. Segment C corresponds to the interval during which the folding fingers 25 rotate from the position corresponding to the end of Segment B to the dwell position at position P13; the folding fingers 25 fold the trailing panel 61 during the interval corresponding to Segment C.

As previously described, the control system 52 establishes average or nominal operating conditions for the servomotor 50. Further, the control system can vary, or offset, those conditions to compensate conveyor speed and spacing variations. In accordance with this invention, the control system 52 can also vary or offset servomotor operating conditions during each folding operation. For Segment A, the control system 52 establishes the velocity as a function of the paper line speed and blank spacing. More specifically, the control system determines the time available and required velocity in response to the interval that will expire with no blank between the folding fingers 25 and the paper line. This time is a function of spacing between the last blank that was folded and the next blank in succession and the speed of the paper line 20. The velocity during Segment B is a function of the carton length, the panel length and the conveyor speed. The control system must control the servomotor 50 so it moves the folding fingers 25 to the position P4 during the time that it takes a strike point on the trailing flap to be positioned above the folding finger 25. The exact location of the strike point can be selected arbitrarily, but a position that is about two-thirds of the distance from the fold line 62 to an edge of the trailing panel provides satisfactory results. The velocity during Segment C is a function of the size of the trailing panel being folded. More particularly, the distance from a fold line 62 to the strike point on a trailing panel 61 and conveyor speed determine the time required to move the fold line 62 to the exit of the folding station.

Thus, during normal operations, the control system establishes a nominal velocity for the servomotor dependent upon carton size, panel size, paper line velocity, blank spacing and other factors. The control system also calculates variations from this nominal velocity for each segment during each folding operation. However, these variations represent only a small fraction of the nominal velocity, so the momentum changes also are minor. It has been found that appropriate adjustments of the various operating parameters will minimize any energy imbalances caused by such velocity variations during each folding operation. The only limit is the physical design of the servomotor, particularly the current limits that the manufacturer imposes. These limits determine the maximum rate of change of momentum that the servomotor can tolerate. However, commercially available servomotors are available that are operable with this invention over a wide range of carton configurations and operating conditions.

Figure 7:
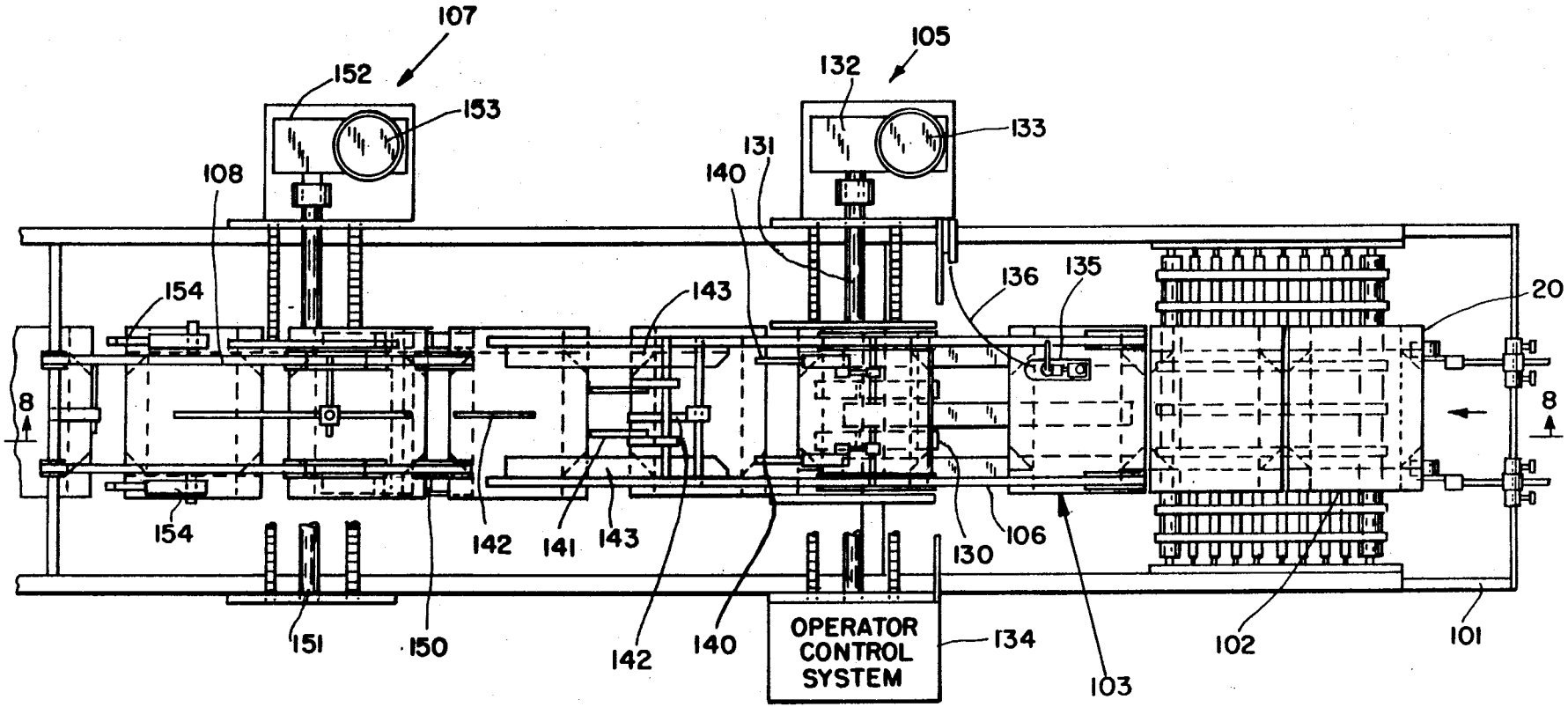
FIG. 7 is a top view of a portion of an in-line blank folding system incorporating a specific embodiments of the invention for folding panels at two backfolding stations.
Figure 8:
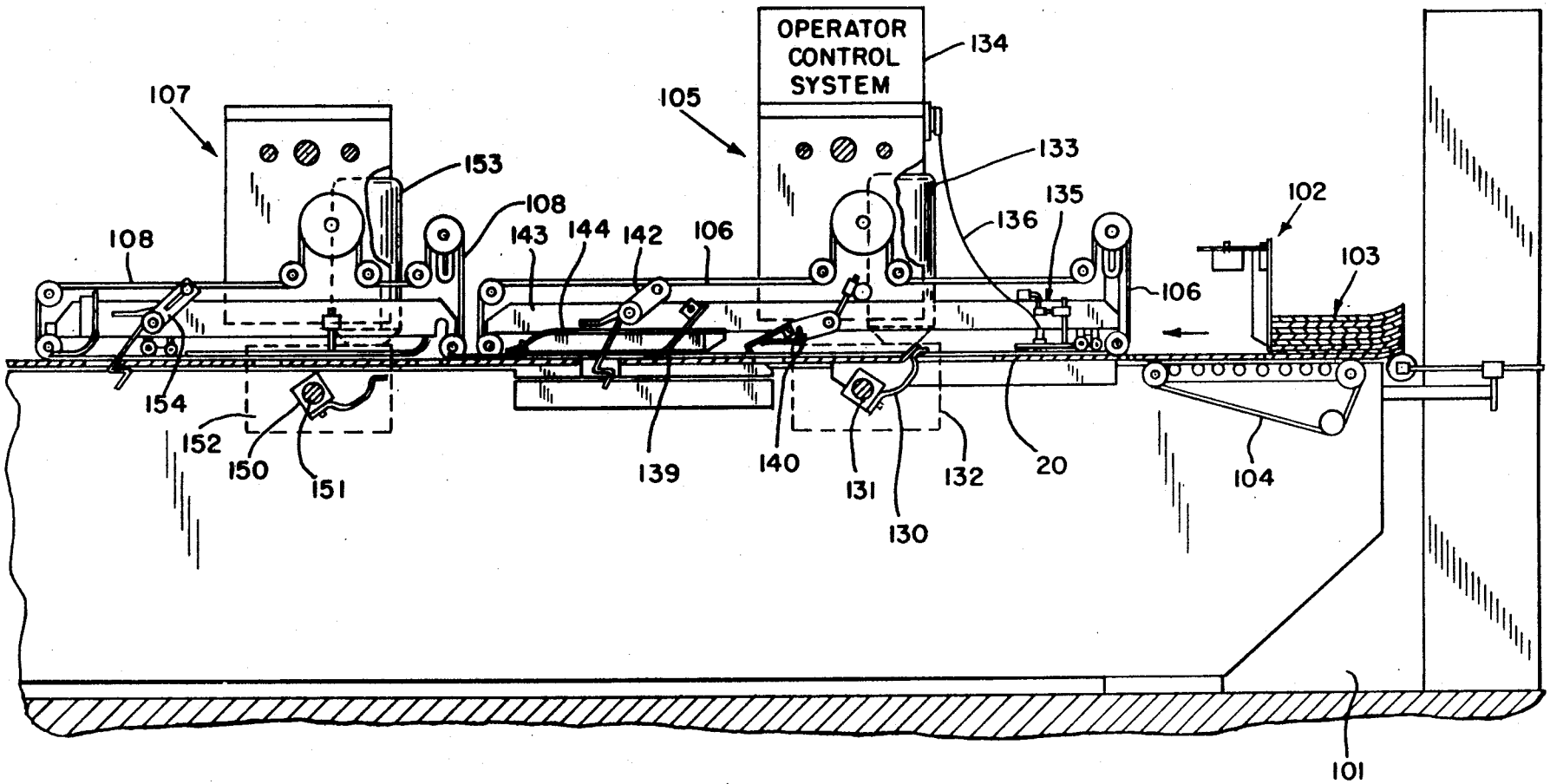
FIG. 8 is a side view of the apparatus shown in FIG. 7.

With this understanding of the operation of the system shown in FIGS. 1 through 6 it will be helpful to now describe a specific implementation of this invention in a paper line utilizing two backfolding stations. In FIGS. 7 and 8, blanks move from right to left along the paper line 20. The folding apparatus comprises a frame 101 with a blank feeder 102, at the right end thereof, that feeds blanks 103 onto a first conveyor 104 individually and successively at more or less predetermined intervals and spacing. Such devices are well known in the art.

As the blanks 103 move from the blank feeding station 102, they encounter a first backfolding station 105. A conveyor system 106 connected to a main drive motor (not shown) moves each blank past the first folding station 105 to a second backfolding station 107. A conveyor 108 then moves each blank through the second folding station 107 to other folding apparatus downstream.

As shown in FIG. 9A, a blank 103 typically has a central panel 111 with a leading edge panel 112 for being folded about a fold line 113. Leading edge corners or end panels 114 fold about fold lines 115; a cut 116 separates the leading edge panel 112 and corners 114 so the folding operations are conducted independently on the panel 112 and the corners 114. The leading edge panel 112 additionally has a diagonal fold line 117 that intersects the fold line 113 and cut 116 to define an outer triangular section 118 as a gluing tab 118. The blank 103 additionally includes side panels 120 formed at fold lines 121. A trailing edge panel 122 extends along a fold line 123; trailing corners or end panels 124, along fold lines 125. Cut lines 126 separate the trailing edge panel 122 and the corners 124. Diagonal fold lines 127 on the trailing edge panel 122 define glue tabs 128 that are analogous to the tabs 118.

FIG. 9A depicts a blank 103 as the blank feeder 102 in FIGS. 7 and 8 dispenses it onto the conveyors and as it reaches the first backfolding station 105. The first backfolding station 105 folds the trailing panel 122 forward on the fold line 123 and grabs the triangular glue tabs 128 at the ends of the trailing panel 122, folding them back over the panel 122 as shown in FIG. 9B. Other elements, as will be described, engage the leading edge panel 112 and fold it back along its fold line 113. Other apparatus engages the triangular glue flaps 118 as shown in FIG. 9C. Thus the blank exits the first backfolding station 105 as shown in FIG. 9D with the leading and trailing edge panels 112 folded over the top of the central panel 111 along their respective fold lines 113 and 123. In addition the glue tabs 118 and 128 overlie the panels 112 and 120, respectively.

The second folding station 107 folds the corners 114 and 124. Initially the apparatus folds the trailing corners 124 forward on their fold lines 125 as shown in FIG. 9E. Then the other apparatus in the station folds the corners 114 back on their fold lines 115. The blank 103 exits the second station 107 with the configuration shown in FIG. 9F.

Figure 14:
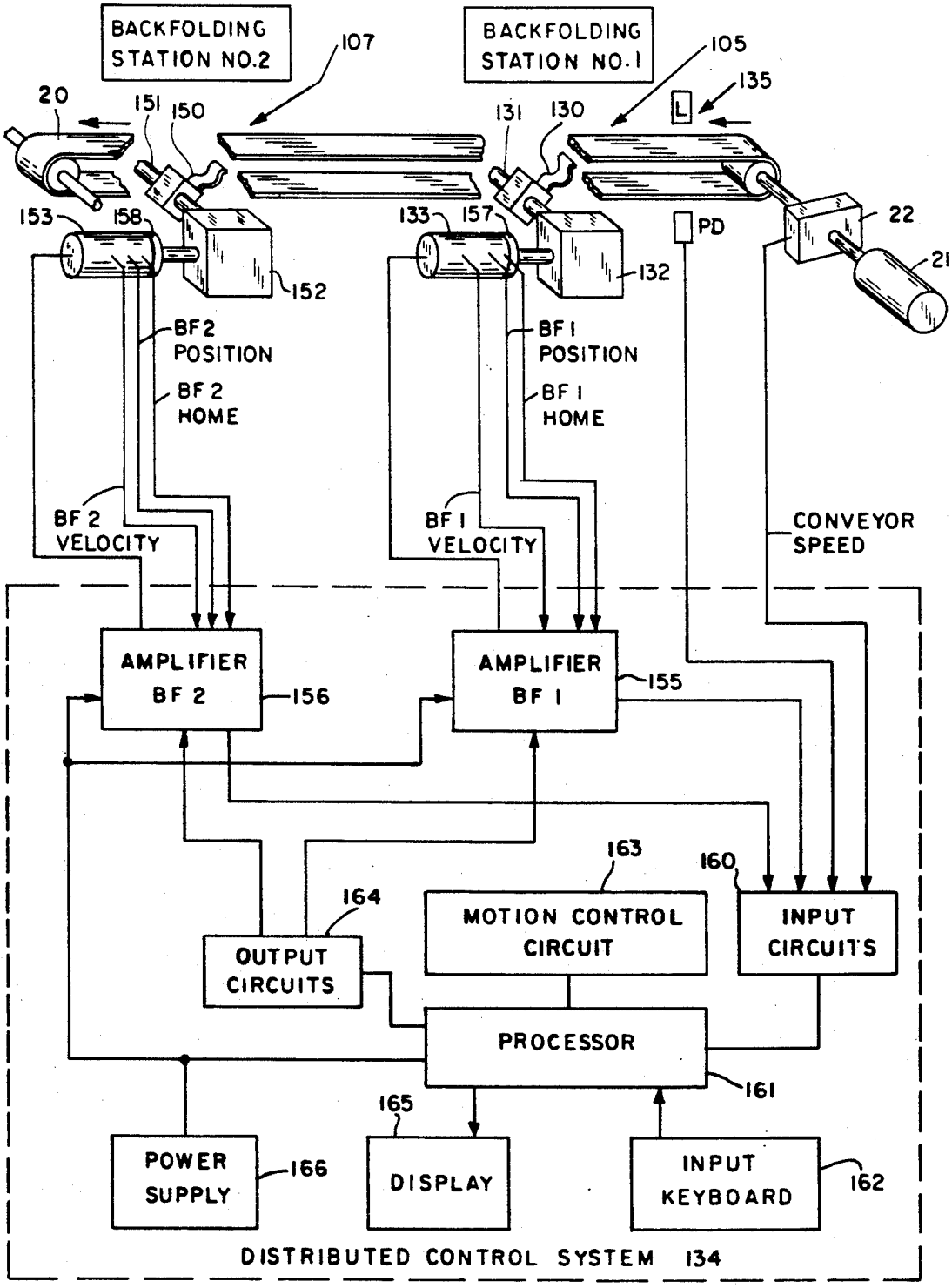
FIG. 14 is a block diagram useful in understanding the operation of a control system for the apparatus shown in FIGS. 7 and 8.

Referring specifically to FIGS. 7, 8 and 14, the first backfolding station 105 comprises folding fingers 130 mounted to an output shaft 131 driven by a cam operated indexing system 132 and servomotor 133. A distributed control system 134 provides operator input for controlling the operations of the fingers 130 and the second backfolding station 107. A single photodetector 135 connects to the distributed control system 134 by means of a cable 136 shown specifically in FIGS. 7 and 8.

Figure 10:
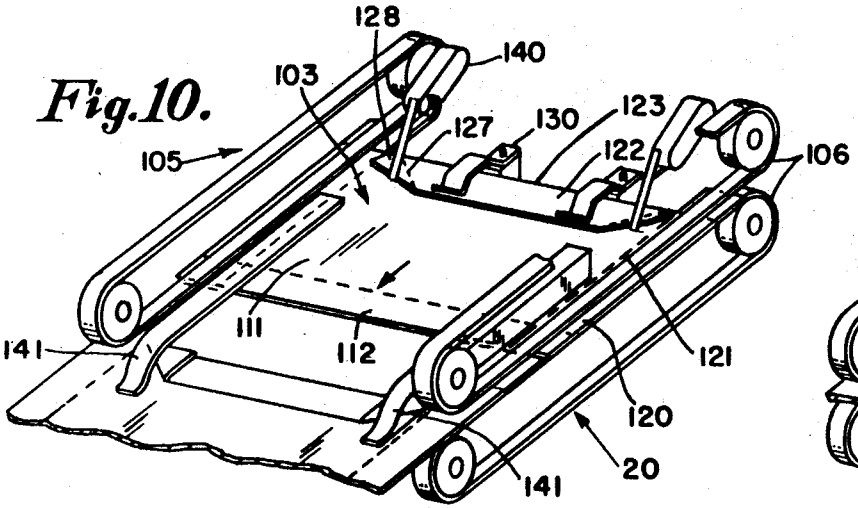
FIG. 10 is a detailed view of a portion of the first backfolding station shown in FIG. 7 and 8.
Figure 12:
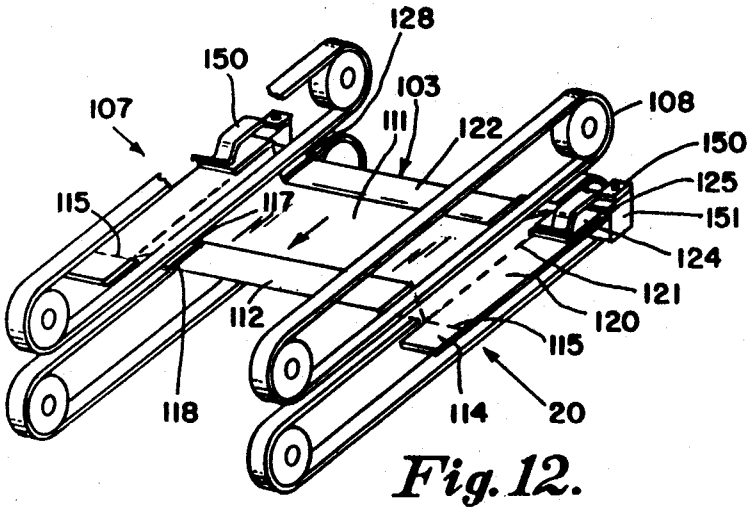
FIG. 12 is a detailed perspective view of a portion of a second backfolding apparatus shown in FIGS. 7 and 8.

Now referring to FIGS. 7, 8 and 10, the conveyors 106 engage the blank 103 along the edge panels 120. FIG. 10 depicts the fingers 130 in the previously described dwell position engaging the trailing panel 122 after folding it. In addition fingers 140 at ends of the trailing panel 122 engage the tabs 128 to begin folding them. Still referring to the station 105, as the blank progresses, first hold down fingers 141 shown in FIG. 10 engage the trailing edge panel 122 to maintain its orientation as the blank 103 moves downstream. Another finger 139 engages the leading edge flap 112 and holds it stationary as the blank 103 advances thereby to fold the leading edge panel 112 about the fold line 113. Slides 143 at each side of the station 105 fold the tabs 118 about the diagonal fold lines 117. Hold down fingers 144 engage the glue tabs 118. Thus, the operations shown in FIGS. 10 and 11 produce a blank 103 as shown in FIG. 9D.

Figure 11:
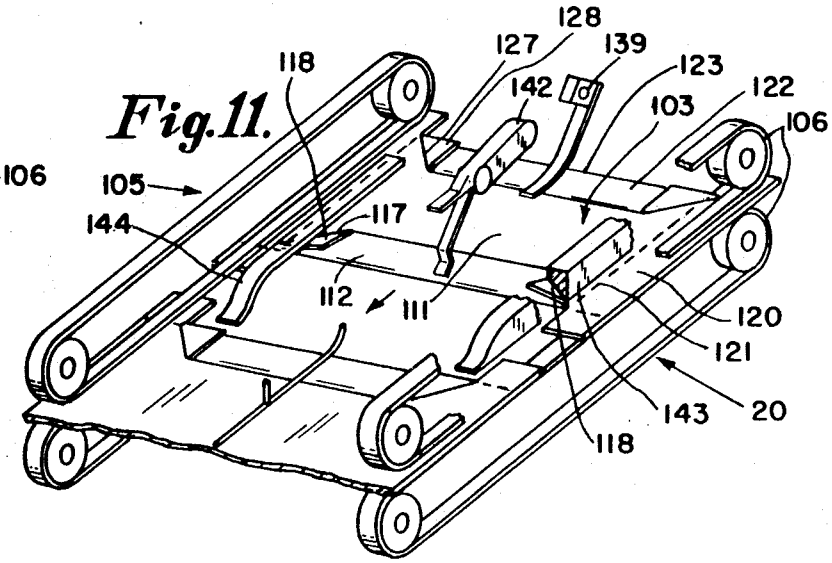
FIG. 11 is a detailed view of another portion of the backfolding apparatus shown in FIGS. 7 and 8.

Now referring to the second folding station 107 shown in FIGS. 7, 8, 12 and 13, the conveyor belt system 108 is displaced inwardly from the conveyor system 106 shown in FIGS. 10 and 11 to engage the blanks 103 on lines through the glue flaps 118 and 128. This effectively maintains the leading and trailing edge panels 112 and 122 in their folded positions.

Figure 13:
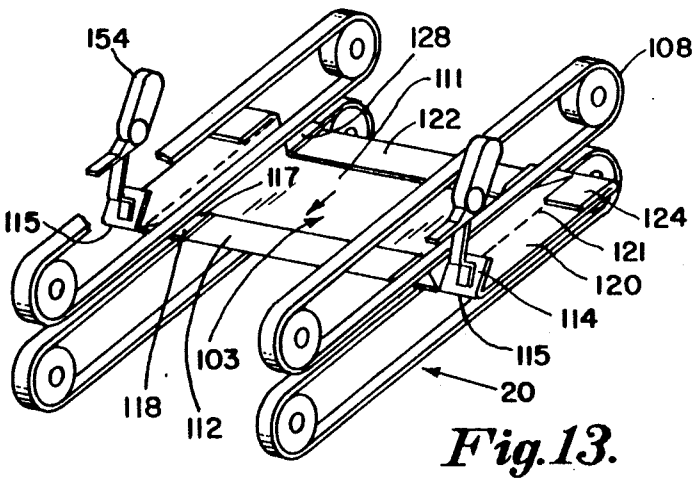
FIG. 13 is a perspective view of the detail of another portion of the second backfolding apparatus shown in FIGS. 7 and 8.

As shown in FIG. 14, an output shaft 151 drives a second set of fingers 150 from a cam operated indexer 152 and servomotor 153. The distributed control system 134 provides the appropriate signals for the servomotor 153 independently of servomotor 133. The fingers 150, shown in the dwell position in FIG. 12, have folded the corners 124 forward about the fold lines 125. As shown in FIG. 13, fingers 154 fold the corners 114 about the fold lines 113 thereby to complete the folding operation and produce a final blank that leaves the folding station 107 in the form shown in FIG. 9F.

Now referring to FIG. 14, the distributed control system 134 receives signals from and transmits a number of signals to the backfolding stations 105 and 107. The distributed control system 134 includes input circuits in the form of various interfaces for receiving signals from the tachometer 22, the position detector 135, and from servo amplifiers 155 and 156 and other devices such as encoders 157 and 158 that provide BF1 and BF2 HOME signals that correspond to predetermined positions of the fingers 130 and 150 respectively. Typically the HOME position corresponds to the P13 position in FIG. 6. The signals from the servo amplifiers 155 and 156 represent the position and velocity of each of the servomotors 133 and 153, respectively. A processor 161 converts this information, along with information from the input keyboard 162, into signals for motion control circuitry 163. The motion control circuitry 163 comprises dedicated processing elements that calculate the control signals for the servomotors 133 and 153 independently. The processor 161 routes corresponding signals to the amplifiers 155 and 156 through output circuits 164. A display 165 provides feedback information for the operator. A power supply 166 provides power for the system.

The components for a distributed control system shown on FIG. 14 are readily available. One such control system can be configured from components of Reliance Electrical Industrial Co. of Cleveland, Ohio. The interconnection and programming of such a system will be apparent from the following discussion:

Before discussing the operation of the control system shown in FIG. 14, it will be helpful to list known relationships, as follows:

1. The distances from the photodetector 135 to the axes of the output shafts 131 and 151 are known and fixed. It is also possible to utilize separate photodetectors for each backfold station.
2. The tachometer 22 reliably indicates the speed the blanks travel along the paper line 20.
3. The length of a blank and the size of its trailing panel are both provided through the input keyboard 162.

The processor 161 and the motion control circuit 163 use input signals along with signals from the amplifiers 155 and 156 for calculating, on an iterative and continuing basis.

1. The time interval before each blank that passes the photodetector 135, or the respective one of multiple photodetectors, in succession reaches either the station 105 or 107.
2. The time required to move each of the fingers 130 or 150 from a position corresponding to the position P4 in FIG. 6 so the arm fingers engage a trailing panel or corners at an appropriate time. Conveyor speed determines the time available to move the fingers.
3. The time interval to move the fingers from position P4 to position P13 and the velocity and acceleration profiles required during this interval.

The circuitry and programs of the distributed control system 134 shown in FIG. 14 control each of the servomotors 133 and 153 independently. The following description is limited to the discussion of a single backfolding station, namely backfolding station 105. The processes that the distributed control system 134 uses to control the servomotors 133 and 153 independently are themselves independent processes run in sequence. However, the distributed control system 134 operates at a sufficiently high speed that in terms of the time intervals involved with the backfolding stations, the independent processes appear to occur simultaneously and in parallel.

Figure 15:
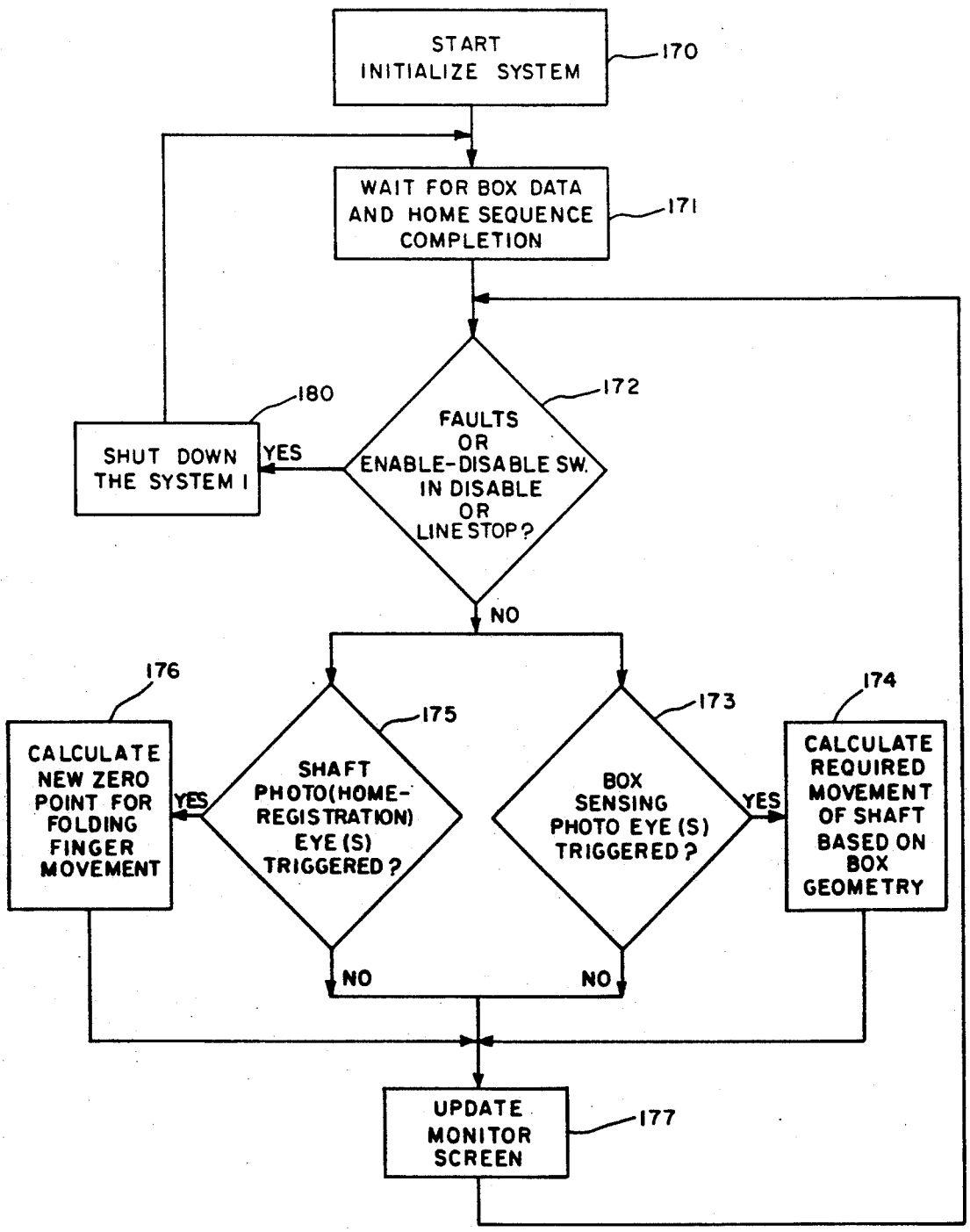
FIG. 15 is a block logic diagram that defines the operation of the control system shown in FIG. 14.

FIG. 15 describes the basic operations by which the processor 161 and motion control circuit 163 provide the various control signals for the backfolding stations. In accordance with the conventional techniques, the processor 161 initializes the system in step 170 thereby to establish initial variable and register values and provide initial information on the display 165. Then the processor 161 "waits" for additional input from the keyboard 162 and the beginning of a job.

At the beginning of each job, an operator uses the input keyboard 162 to provide information that the distributed control system 134 utilizes to establish supplemental and intermediate values. This information includes blank length, trailing panel length, finger size and similar information. The distributed control system 134 also uses other information that may be stored in the processor for a particular machine or provided through the input keyboard 162. This includes measured information, such as the distance from the photodetector system 135 to the center line for each of the output shafts 131 and 151 and the distances between each of the output shafts and a point at which the fingers first strike the trailing flap (i.e., at the P4 position in FIG. 6). The distributed control system 134 also calculates various other values based upon this input and measured data. In one specific implementation at any given time the distance a blank must travel to reach a predetermined point is calculated as (1) the measured distance from the photodetector system 135 to the strike point minus (2) one-third of the trailing flap length minus (3) the actual distance traveled.

After an operator supplies all the information and starts the paper line, step 171 awaits for the arrival of a blank at the photodetector system 135. In addition the programs associated with backfolding station 105 await the arrival of the finger assembly at the home position represented by the BF1 HOME signal.

When this occurs, the processor 161 and motion control circuit 163 use step 172 to determine if any default conditions exist. Normally none exist so the motion control circuit 163 performs two functions and these may be performed by hardware in parallel.

Whenever the motion control circuit 163 detects the arrival of a blank at the photodetection system 135 in step 173, step 174 calculates information that establishes the velocity of the output shaft so that the fingers 130 strike the trailing panel at the appropriate position based upon paper line velocity. In parallel step 175 monitors the BF1 HOME signal. When the encoder 157 produces this signal, step 176 calculates information for moving the fingers 130 from the HOME position.

Regardless of the control paths the processor 161 uses in performing steps 173 through 176, step 177 updates the monitor screen and then control returns to step 172 to monitor any default and to begin another duration.

If a fault occurs, step 172 immediately branches to step 180 as error condition. In this embodiment step 180 stops the backfolding operation for that blank and returns to step 171 to await a next blank. Other fault responses can be used.

Therefore, the processor 161 and motion control circuit 163 utilize signals that represent various conditions in each backfolding station with respect to each blank entering each backfolding station independently. If the paper line velocity and blank spacing are relatively constant, the control system drives the servomotors 133 and 153 at a relatively constant velocity. During each blank folding cycle, the distributed control system 134 causes amplifiers 155 and 156 to transfer additional energy to the servomotors 133 and 153 during the acceleration of the output shafts 131 and 151 so the servomotors remain at a constant velocity. During decelerations, the distributed control system 134 reduces the energy being transferred to the servomotors 133 and 153 to compensate for the decreased momentum introduced by the indexing system so that the servomotor continues to rotate at a constant velocity The distributed control system 134 only changes the velocity of the servomotors 133 and 153 to compensate uneven blank spacing or paper line velocity changes.

The implementation of the foregoing control system described with respect to FIGS. 14 and 15 depends upon the particularly selected equipment utilized in the distributed control system 134. Typically such a distributed control system comprises a programmable controller and related equipment that requires programming. As such programs are dependent upon the selected equipment and any specific implementation will be apparent from the foregoing description, no specific embodiment of such a program is included in this description.

In summary, there has been disclosed backfolding station that overcomes many of the problems encountered with prior art apparatus A system constructed in accordance with this invention allows the backfolding system to operate at a substantially constant angular momentum with the changes in momentum representing a small portion of the total momentum of the system. As a result, the apparatus, operates with greater throughput and minimal overhead.

This invention has been disclosed in terms of certain embodiments. It will be apparent that many modifications can made to the disclosed apparatus without departing from the invention.

Therefore, it is the intent of the appended claims to cover all such variations and modifications as come within true spirit and scope of this invention.

What is claimed as new and desired to be secured by patent of the United States is:

1. In a paper box folding machine for forming individually and successively carton blanks into folded cartons, said machine including conveyor means for transporting successive blanks at a predetermined nominal speed and spacing along a paper line and backfolding means for folding a trailing panel of each blank individually and successively forward about a fold line transverse to the paper line, the improvement of a said backfolding apparatus comprising:

A. indexing means having an input shaft and having an output shaft transverse to and disposed below said conveyor means, said indexing means establishing a predetermined angular position of said indexing means output shaft for each angular position of said input shaft whereby repeatable linear and non-linear relationships exist between the speeds of said input and output shafts, B. servomotor means for driving said indexing means input shaft continuously, C. finger means connected to said indexing means output shaft having a radially extending finger for engaging and folding the trailing panels of each successive blank forward about a respective fold line as each blank passes said backfolding apparatus, and D. control means for operating said servomotor means to drive said indexing means input shaft at a nominally constant angular velocity established by the nominal blank spacing and the nominal speed of said conveyor means.

2. A backfolding apparatus as recited in claim 1 wherein said conveyor means is subject to speed variations and said control means includes speed signal means for generating a conveyor speed signal dependent upon the speed of said conveyor means, said control means altering the speed of said servomotor means and said indexing means input shaft in response to the signal from said speed signal generating means.

3. A backfolding apparatus as recited in claim 1 wherein the spacing between successive blanks can vary and said control means includes reference signal generating means for generating a position signal each time a blank passes a predetermined position along the paper line, said control means varying the speed of said servomotor means and said indexing means input shaft in response to reference signal generator means indicating a spacing variation.

4. A backfolding apparatus as recited in claim 3 wherein said conveyor means is subject to speed variations and the spacing between successive blanks can vary, said control means additionally including speed signal generating means for generating a conveyor speed signal dependent upon the speed of said conveyor means, said control means varying the speed of said servomotor means and said indexing means input shaft in response to the conveyor speed and position signals thereby to position the finger means below a trailing panel when the trailing panel overlies said finger means.

5. A backfolding apparatus as recited in claim 4 wherein said control means additionally includes input means for producing inputs for said control means representing carton blank and trailing panel sizes, said control means additionally being responsive to said input means for varying the speed of said servomotor means and the indexing means input shaft.

6. A backfolding apparatus as recited in claim 5 wherein the machine runs in a batch mode in which each batch of carton blanks has the same configuration, said backfolding apparatus being adapted to operate with different batches defined by a range of blank configurations and sizes and said finger means includes a base member mounted to said indexing means output shaft and means for securing one of a predetermined number of fingers to said base member, said input means identifying the selected finger to said control means.

7. A backfolding apparatus as recited in claim 6 wherein said indexing means output shaft has a plurality of said finger means attached thereto.

8. A backfolding apparatus as recited in claim 4 wherein said indexing means defines, for each continuous revolution of said input shaft, a discontinuous revolution of said indexing means output shaft including a first interval during which said finger means dwells, a second interval during which said finger means moves below the paper line, and a third interval during which said finger means accelerates and decelerates to fold the trailing panel.

9. A backfolding apparatus as recited in claim 8 wherein said indexing means drives said output shaft at a substantially constant speed during the second interval and varies the velocity between a maximum and zero during the third interval.

10. A backfolding apparatus as recited in claim 4 wherein said control means includes programmable controller for setting a nominal speed for said servomotor means dependent upon a nominal speed for said conveyor means and having a first program for altering the speed of said servomotor means in response to changes in conveyor speed thereby to synchronize said indexing means output shaft with conveyor speed.

11. A backfolding apparatus as recited in claim 10 wherein said programmable controller means has another program for altering the nominal speed of said servomotor means in response to said reference signal generating means thereby to synchronize said indexing means output shaft to the position of successive blanks notwithstanding the spacings between successive blanks.

12. In a paper box folding machine for forming individually and successively carton blanks into folded cartons, said machine including a conveyor means for transporting successive blanks at a predetermined nominal conveyor speed and predetermined nominal spacing between successive blanks along a paper line, each blank having a trailing central panel and separately foldable trailing end panels and backfolding apparatus for folding said trailing central and end panels of each individual and successive blank forward about the respective fold lines, said backfolding apparatus comprising:

A. A first folding station for folding one of the trailing central and end panels and a second folding station for folding the other of the trailing central and end panels, each of said first and second stations being spaced along the paper line and including:

i. indexing means having an input shaft and having an output shaft transverse to and disposed below said conveyor means, said indexing means establishing a predetermined angular position of said indexing means output shaft for each angular position of said input shaft whereby repeatable linear and non-linear relationships exist between the velocities of said input and output shafts, ii. servomotor means for driving said indexing means input shaft continuously, and iii. finger means connected to said indexing means output shaft having a radially extending finger for engaging and folding the corresponding ones of the trailing central or end panels of each successive blank forward about a respective fold line as each blank passes one of said folding stations, and B. control means operating independently each said servomotor means to drive said corresponding indexing means input shaft at a nominally constant angular velocity established by the nominal spacing and the nominal speed of said conveyor means.

13. A backfolding apparatus as recited in claim 12 wherein said conveyor means is subject to speed variations and said control means includes speed signal means for generating a conveyor speed signal dependent upon the speed of said conveyor means, said control means independently altering the speed of each said servomotor means and said corresponding indexing means in response to the signal form said speed signal generating means.

14. A backfolding apparatus as recited in claim 12 wherein said control means includes reference signal generating means for generating a position signal each time a blank is at a predetermined position along the paper line, said control means independently varying the speed of each said corresponding servomotor means and indexing means input shaft in response to the position signal from said reference signal generator means.

15. A backfolding apparatus as recited in claim 14 wherein said conveyor means is subject to speed variations and the spacing between successive blanks can vary, said control means additionally including speed signal generating means for generating a conveyor speed signal dependent upon the speed of said conveyor means, said control means independently varying the speed of each of said servomotor means and corresponding indexing means input shaft in response to the conveyor speed and position signals thereby to position a corresponding finger means at each of said backfolding stations independently below a trailing panel when the trailing panel overlies said finger means.

16. A backfolding apparatus as recited in claim 15 wherein said control means additionally includes input means for producing inputs for said control means representing carton and trailing panel size, said control means additionally being responsive to said input means for varying independently the speed of each said servomotor means and corresponding indexing means input shaft.

17. A backfolding apparatus as recited in claim 16 wherein the machine runs in a batch mode in which each batch of blanks has the same configuration, said backfolding apparatus being adapted to operate with different batches defined by a range of blank configurations and sizes and each said finger means includes a base member mounted to said indexing output shaft and means for securing one of a predetermined number of fingers to said base member, said input means identifying the selected finger to said control means.

18. A backfolding apparatus as recited in claim 17 wherein each said indexing means output shaft has a plurality of said finger means attached thereto.

19. A backfolding apparatus as recited in claim 15 wherein each said indexing means defines, for each continuous revolution of said input shaft, a discontinuous revolution of said indexing means output shaft including a first interval during which said corresponding finger means dwells, a second interval during which said finger means moves below the paper line, and a third interval during which said finger means accelerates and decelerates to fold the corresponding ones of the trailing central and corner panels.

20. A backfolding apparatus as recited in claim 19 wherein each said indexing means drives said output shaft at a substantially constant speed during the second interval and varies the speed between a maximum and zero during the third interval.

21. A backfolding apparatus as recited in claim 15 wherein said control means includes a programmable controller means for setting independently a nominal speed for each said servomotor means dependent upon a nominal speed for said conveyor means and having first programs for altering independently the speed of each said servomotor means in response to changes in conveyor speed thereby to synchronize independently each of said indexing means output shaft with conveyor speed.

22. A backfolding apparatus as recited in claim 21 wherein said programmable controller means has other programs for altering the nominal speed of said servomotor means independently in response to said reference signal generating means thereby to synchronize independently each said indexing means output shafts to the position of successive blanks notwithstanding the spaces between successive blanks.

* * * * *